United States Patent [19]

Holmes

[11] Patent Number: 4,785,692

[45] Date of Patent: Nov. 22, 1988

[54] RAILROAD TIE PLUG DRIVER

[76] Inventor: Dennis W. Holmes, 280 N.W. 83rd, Redmond, Oreg. 97756

[21] Appl. No.: 908,868

[22] Filed: Sep. 12, 1986

Related U.S. Application Data

[63] Continuation of Ser. No. 799,572, Nov. 19, 1985, abandoned.

[51] Int. Cl.[4] ..... B25B 9/02

[52] U.S. Cl. ..... 81/27; 81/44; 81/463

[58] Field of Search ..... 81/20, 44, 27, 463, 81/464

[56] References Cited

U.S. PATENT DOCUMENTS

| | | | |
|---|---|---|---|
| 716,274 | 12/1902 | Peirce, Jr. . | |
| 1,127,838 | 2/1915 | Willers | 81/44 |
| 2,272,760 | 2/1942 | Allen | 81/44 |
| 2,470,891 | 5/1949 | Hammers | 81/3 |
| 2,622,781 | 12/1952 | Polson | 226/84 |
| 2,783,799 | 3/1957 | Hart | 81/44 |
| 2,979,092 | 4/1961 | Bradford | 81/44 |
| 3,036,482 | 5/1962 | Kenworthy et al. | 81/52.35 |
| 3,114,331 | 12/1963 | Elliott | 104/17 |
| 3,136,040 | 6/1964 | Bauer et al. | 29/203 |
| 3,144,835 | 8/1964 | Pehoski et al. | 104/17 |
| 3,342,228 | 9/1967 | Reid | 81/44 |
| 3,529,497 | 9/1970 | Brooks | 81/52.35 |
| 3,568,657 | 3/1971 | Gue | 81/27 |
| 4,261,424 | 4/1981 | Gonterman et al. | 173/91 |

*Primary Examiner*—Frederick R. Schmidt
*Assistant Examiner*—Judy J. Hartman
*Attorney, Agent, or Firm*—Chernoff, Vilhauer, McClung & Stenzel

[57] ABSTRACT

A tool for driving wooden plugs in spike holes of railroad ties following removal of railroad spikes from the wooden tie prior to track regauging and/or replacement. An elongated main body rod of steel is provided having a permanently affixed collar or washer at one extreme end thereof and another permanently affixed collar or washer approximately midway thereof. Slidably mounted between the two collars is a hand-operated driving weight. The other end of the elongated rod has a reduced rod extension portion which has a slidable plug holding sleeve thereon. The extreme tip of this other end is threaded and receives an adjusting nut on the threads for predetermining the desired depth of wooden plug driving into a railroad tie.

18 Claims, 1 Drawing Sheet

RAILROAD TIE PLUG DRIVER

This application is a continuation of application Ser. No. 06/799,572, filed Nov. 19, 1985, now abandoned.

BACKGROUND OF THE INVENTION

1. Field of the Invention

This invention relates generally to devices for inserting plugs into the holes in railroad ties after removal of railroad spikes therefrom.

2. Description of the Prior Art

A common problem with known devices of conventional type for plugging holes in railroad ties after removal of railroad spikes associated with the railroad tracks, and prior to re-gauging or railroad replacement, is that known devices are not designed to drive the plugs below the bottom of the tie plate.

Another common problem with known type devices is that they are unduly complex and expensive, and require a great deal of skill in the operation thereof.

Existing prior patents which may be pertinent to the present invention are as follows:

U.S. Pat. No. 716,274—12/10/02—C. L. Peirce, Jr.
U.S. Pat. No. 2,470,891—5/24/49—W. P. Hammers
U.S. Pat. No. 2,622,781—12/23/52—M. O. Polson
U.S. Pat. No. 3,036,482—5/29/62—K. Kenworthy et al
U.S. Pat. No. 3,114,331—12/17/63—H. H. Elliott
U.S. Pat. No. 3,136,040—6/9/64—J. G. Bauer et al
U.S. Pat. No. 3,144,835—8/18/64—W. L. Pehoski et al
U.S. Pat. No. 3,529,497—9/22/70—D. G. Brooks
U.S. Pat. No. 4,261,424—4/14/81—R. N. Gonterman et al These patents generally show devices for driving and/or removing plugs and similar articles; however, none of these known prior art devices offer the new and novel features of the present invention.

SUMMARY OF THE INVENTION

An object of the present invention is to provide a driver for the wooden plugs used with railroad ties to fill the holes therein which are present at the removal of the railroad spikes therefrom prior to adjusting track gauge and/or railroad track replacement.

Another object of the present invention is to provide a plug installer for railroad ties which will drive the plugs below the bottom of the tie plate.

A further object of this invention is to provide a driving tool for wooden plugs used to fill existing holes in railroad ties, wherein said driver will hold the plug during initial installation thereof in the railroad tie, and then the tool can be used to drive the wooden plug far enough into the spike hole so that the upper surface thereof will be substantially below the upper surface of the railroad tie.

Another further object of the present invention is to provide a wooden plug driver for railroad ties which is adjustable so that the wooden plug can be driven at different predetermined depths into the railroad tie.

Another further object of the present invention is to provide an easily handled and used driving tool which simply and accurately can insert wooden plugs into spike holes in railroad ties.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
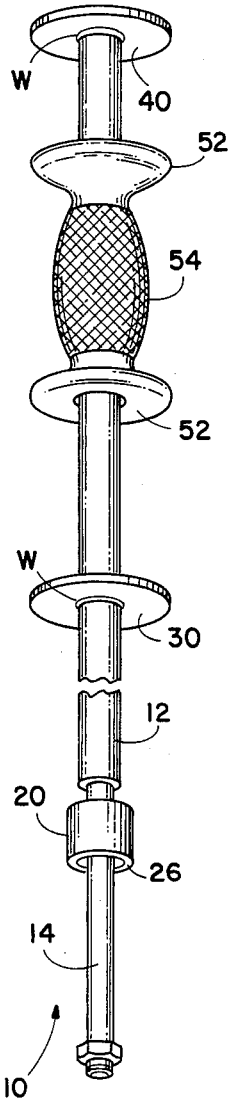
FIG. 1 is a perspective view of the present invention.

Referring to FIG. 1 of the drawing, reference numeral 10 indicates in general the tool of the present invention. This driving tool comprises an elongated body rod 12 having at one end thereof a reduced diameter end portion 14. The tip of the end portion 14 is provided with an adjusting nut 16 threaded upon threads 18 as provided on the very tip of extension rod 14.

Affixed to the other end of the main body rod 12 is a collar or washer 40, and approximately midway of the main body rod 12 is affixed another washer 30. Preferably, washers 30 and 40 are permanently affixed to the main body rod by welding W, as shown. Of course, other means of permanently affixing same may be used, if desired. Slidably mounted on the main body rod 12 between washers 30 and 40 is a dumbbell-shaped driving weight 50. As best seen in the cross-section of FIG. 2, the driving weight 50 has the enlarged ends 52 therewith and the eliptically curved center portion therebetween, which, or course, in side view, resembles quite closely a dumbbell. Preferably, the handle gripping portion of the driving weight 50 is provided with knurling or cross-hatching 54 for providing positive, easy gripping by the user of the device.

Figure 2:
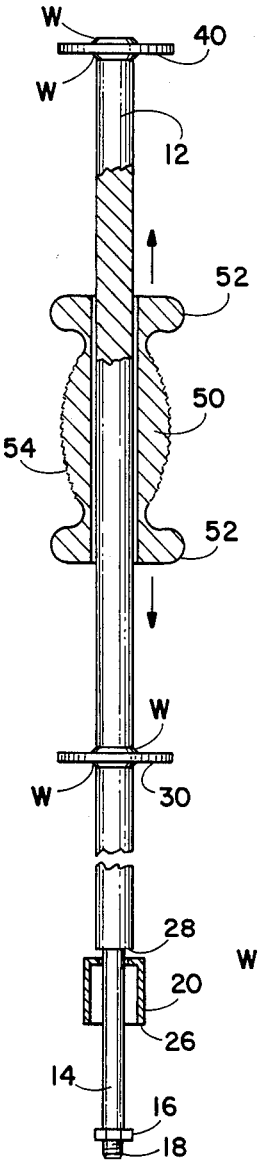
FIG. 2 is a side elevational view, partly in cross-section, of the driving tool depicted in FIG. 1.
Figure 3:
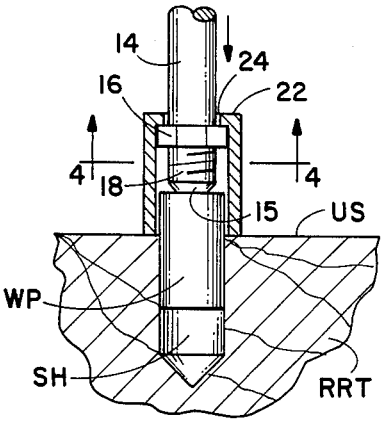
FIG. 3 is an enlarged lower end view of the tool of FIGS. 1 and 2, showing how the tool is used to insert a wooden plug into a railroad tie.

As best seen in FIGS. 2 and 3, the reduced diameter extension rod 14 has a slidable sleeve 20 thereon. The sleeve 20 has one end partially closed 22, which has a central aperture 24 therethrough of just slightly larger diameter than the outside diameter of extension rod 14. Thus, the retention sleeve, once mounted upon the extension rod 14, can slide between the shoulder 28, FIG. 2, and the adjusting nut 16. A chamfered or beveled edge 15 is provided at the slotted tip end of the extension rod 14.

As best seen in FIG. 3, when the sleeve 20 is moved into contact with the adjusting nut 16, a wooden plug WP can be inserted into the open end of the sleeve for frictional retention therein. Then the user can insert the other free end of the wooden plug WP into a spike hole SH which exists in the railroad tie RRT after removal of previous railroad tracks and railroad spikes therefrom.

As can be easily visualized, by operating the driving weight 50, a user can quickly and easily drive the wooden plug WP into the hole SH left by the removed railroad spike. As can be seen in FIG. 3, the depth of the hole SH is longer than the length of the wooden plug WP. Therefore, by using this tool, it is very easy to drive a wooden plug far enough into the spike hole SH so that the upper surface thereof will be substantially below the upper surface US of the railroad tie.

Figure 4:
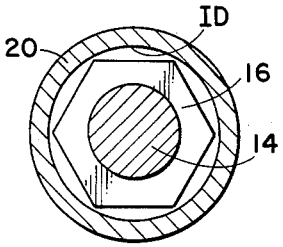
FIG. 4 is a cross-sectional view taken generally along line 4—4 of FIG. 3.

FIG. 4 shows in cross-section the diameter of extension rod 14, the adjusting nut 16 as threaded on the end thereof, and the inner and outer circumferences of the slidable sleeve 20.

Preferably, the tool is made from a solid steel rod approximately 63" long and approximately 1" in diameter at the main body portion 12. The welded washer or collar 30 is preferably fixed at about 30½" from the upper welded washer or collar 40. Of course, slight variations in these dimensions are encompassed by this invention; however, the inventor has found that these sizes work most efficiently. The reduced diameter extended rod 14 can be machined from the 1" diameter steel rod 12 to provide the reduced diameter thereof and the sleeve retaining shoulder 28. The hole 24 in sleeve 20 is just slightly larger than the reduced diameter of extension rod 14, and as indicated previously, the inner diameter ID of slidable plug retention sleeve 20 is approximately the size of the external diameter of the wooden plugs as used with the tool.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

I claim:

1. A manually operated tool for driving wooden plugs into railroad ties, comprising:

(a) an elongated rod;

(b) collar means affixed to said elongated rod for engagement by a drving weight;

(c) a driving weight defining an aperture extending therethrough slidably mounted on said rod;

(d) cap means fixedly located at a first end of said rod and retaining the driving weight on said rod between said collar means and said cap means;

(e) tip means located at a second end of said rod for continuously maintainng contact with a wooden plug being driven;

(f) stop means associated with said tip means, for engaging an upper surface of a railroad tie plate when a plug has been driven to a predetermined countersunk depth and limiting the depth to which said wooden plug can be countersunk below said upper surface into said railroad tie by said tool.

(g) a tip aligning sleeve mounted slidably on said second end, said sleeve being movable between a position in which said sleeve extends beyond said tip means, and a position in which said tip means extends beyond said sleeve.

2. The tool of claim 1, wherein said tip means includes a flat, plug-engaging surface on the end thereof.

3. The tool of claim 2, wherein said tip means includes a chamfered circumferential edge surrounding said plug-engaging surface.

4. The tool of claim 3, wherein said stop means at said second end of the elongated rod includes threads on said tip means and an adjusting nut mounted on said threads for adjustably establishing the depth to which said wooden plug can be driven.

5. The tool of claim 1 wherein a portion of said second end of the elongated rod is of reduced diameter and defines shoulder means for limiting movement of said tip-aligning sleeve toward said first end.

6. The tool of claim 1 wherein said stop means at said second end of the elongated rod includes threads on said tip means and an adjusting nut mounted on said threads for adjustably establishing the depth to which said wooden plug can be driven.

7. The tool of claim 6 wherein said tip means includes a flat, plug-engaging surface on the end thereof.

8. The tool of claim 7 wherein said tip means includes a chamfered circumferential edge surrounding said plug-engaging surface.

9. The tool of claim 1, wherein said collar means is a predetermined distance above said second end.

10. A plug driver for holding and inserting wooden plugs into railroad spike apertures in railroad ties prior to re-gauging or reinstalling railroad tracks on said ties, comprising:

(a) an elongated rod;

(b) a first collar affixed to one end of said rod;

(c) a second collar affixed to said rod;

(d) a driving weight slidably mounted on said rod between said collars;

(e) a reduced diameter extension rod portion on the other end of said rod;

(f) tip means located at said other end for continuously maintaining contact with a wooden plug being driven;

(g) tip-aligning sleeve means, slidably disposed on said reduced diameter extension rod portion, for holding said tip means aligned with a wooden plug, said sleeve means being movable between a position in which said sleeve means extends beyond said tip means, and a position in which said tip means extends beyond said sleeve means; and adjustable stop means for engaging an upper surface of a tie plate and establishing the depth to which a wooden plug can be driven below said upper surface, said stop means comprising threads on said tip means and an adjusting nut mounted on said threads.

11. The plug driver of claim 10 wherein said driving weight has a knurled outer surface for providing a good handgrip thereon.

12. The plug driver of claim 10 wherein said two collars are affixed by welding to said rod.

13. The plug driver of claim 10, including shoulder means, defined by the boundary between the main body of the elongated rod and the reduced diameter extension rod portion of said other end, for limiting movement of said tip-aligning sleeve means longitudinally of said rod.

14. The plug driver of claim 13 wherein said tip-aligning sleeve means has an upper end including a radially inwardly projection rim defining an aperture, said aperture being slightly larger than the diameter of the reduced diameter extension rod portion and being disposed about said reduced diameter extension rod portion.

15. The plug driver of claim 10, including adjustable stop means for engaging an upper surface of a railroad tie and limiting the depth to which a wooden plug can be countersunk below said upper surface by said plug driver, said stop means comprising threads on said tip means and an adjusting nut mounted on said threads.

16. The plug driver of claim 15 wherein said tip means includes a flat, plug-engaging surface on the end thereof.

17. The plug driver of claim 16 wherein said tip means includes a chamfered circumferential edge surrounding said plug-engaging surface.

18. The plug driver of claim 10 wherein said second collar is a predetermined distance from said other end.

* * * * *

UNITED STATES PATENT AND TRADEMARK OFFICE

CERTIFICATE OF CORRECTION

PATENT NO. : 4,785,692

DATED : November 22, 1988

INVENTOR(S) : Dennis Holmes

It is certified that error appears in the above-identified patent and that said Letters Patent is hereby corrected as shown below:

| | | |
|---|---|---|
| Col. 3, | line 32 | Change "drving" to read --driving--; |
| | line 39 | Change "maintainng" to read --maintaining--; |
| | line 46 | Change "tool." to read --tool; and--. |
| Col. 4, | line 49 | Change "projection" to read --projecting--. |

Signed and Sealed this

Twenty-fourth Day of July, 1990

*Attest:*

HARRY F. MANBECK, JR.

*Attesting Officer*

*Commissioner of Patents and Trademarks*